US006679337B1

(12) United States Patent
Perry et al.

(10) Patent No.: US 6,679,337 B1
(45) Date of Patent: Jan. 20, 2004

(54) WATER SPRINKLER FIRE PREVENTION SYSTEM

(76) Inventors: Larry J. Perry, 7614 Brighton Ave., Los Angeles, CA (US) 90047; Stanley E. Barnett, Sr., 7614 Brighton Ave., Los Angeles, CA (US) 90047; Stanley E. Barnett, Jr., 7614 Brighton Ave., Los Angeles, CA (US) 90047

( * ) Notice: Subject to any disclaimer, the term of this patent is extended or adjusted under 35 U.S.C. 154(b) by 0 days.

(21) Appl. No.: 10/269,543

(22) Filed: Oct. 11, 2002

(51) Int. Cl.[7] ..... A62C 35/00; B05B 15/06

(52) U.S. Cl. ..... 169/16; 169/5; 169/56; 169/60; 169/61; 239/208; 239/209

(58) Field of Search ..... 169/5, 16, 56, 169/60, 61; 239/208, 209

(56) References Cited

U.S. PATENT DOCUMENTS

| | | | | | |
|---|---|---|---|---|---|
| 1,644,603 | A | * | 10/1927 | O'Neill | 169/16 |
| 1,831,880 | A | * | 11/1931 | Pierce | 169/16 |
| 3,892,277 | A | | 7/1975 | Curran | |
| 4,091,876 | A | | 5/1978 | Valdatta | |
| 4,330,040 | A | * | 5/1982 | Ence et al. | 169/16 |
| 4,836,290 | A | | 6/1989 | Le Lande, Jr. | |
| D315,970 | S | | 4/1991 | Ramos et al. | |
| 5,083,618 | A | | 1/1992 | Hayes | |
| 5,263,543 | A | | 11/1993 | Nigro | |
| 5,692,571 | A | * | 12/1997 | Jackson | 169/16 |
| 5,732,511 | A | * | 3/1998 | Scott | 169/16 |
| 6,109,361 | A | * | 8/2000 | Henderson | 239/208 |
| 6,450,264 | B1 | * | 9/2002 | Christian | 169/16 |
| 6,523,616 | B1 | * | 2/2003 | Wallace | 239/208 |

* cited by examiner

*Primary Examiner*—Robin O. Evans

(57) ABSTRACT

A fire prevention system is provided including a water sprinkler frame mounted on a house and having a plurality of sprayer nozzles for spraying water therefrom upon the receipt thereof. Also included is a water supply tank situated adjacent to the house and connected to the sprinkler frame with a pump coupled therebetween for supplying water to the water sprinkler frame upon the receipt of a heat signal. A plurality of temperature sensors mounted on the ground and spaced from a perimeter of the house or mounted to the top of the house. Such temperature sensors are connected to the pump for transmitting the heat signal thereto upon the detection of a degree of heat greater than a predetermined amount.

7 Claims, 2 Drawing Sheets

WATER SPRINKLER FIRE PREVENTION SYSTEM

BACKGROUND OF THE INVENTION

1. Field of the Invention

The present invention relates to fire extinguishing systems and more particularly pertains to a new water sprinkler fire prevention system for preventing a building from catching fire as a result of a nearby brush fire.

2. Description of the Prior Art

The use of fire extinguishing systems is known in the prior art. More specifically, fire extinguishing systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art fire extinguishing systems include U.S. Pat. No. 4,091,876; U.S. Pat. No. 5,263,543; U.S. Pat. No. 5,083,618; U.S. Pat. No. 4,836,290; U.S. Pat. No. 3,892,277; and U.S. Pat. No. Des. 315,970.

In these respects, the water sprinkler fire prevention system according to the present invention substantially departs from the conventional concepts and designs of the prior art, and in so doing provides an apparatus primarily developed for the purpose of preventing a building from catching fire as a result of a nearby brush fire.

SUMMARY OF THE INVENTION

In view of the foregoing disadvantages inherent in the known types of fire extinguishing systems now present in the prior art, the present invention provides a new water sprinkler fire prevention system construction wherein the same can be utilized for preventing a building from catching fire as a result of a nearby brush fire.

The general purpose of the present invention, which will be described subsequently in greater detail, is to provide a new water sprinkler fire prevention system apparatus and method which has many of the advantages of the fire extinguishing systems mentioned heretofore and many novel features that result in a new water sprinkler fire prevention system which is not anticipated, rendered obvious, suggested, or even implied by any of the prior art fire extinguishing systems, either alone or in any combination thereof.

To attain this, the present invention generally comprises a water sprinkler frame having a plurality of linear portions. Each linear portion has a pipe with an inner plastic layer and an outer metallic layer. As shown in FIG. 3, a heat shield is provided including a planar top face, a pair of tapering planar side faces, and a pair of mounting tabs extending from the side faces in parallel relationship with the top face. In use, the mounting tabs of the heat shield are secured to a house with the pipe residing within an interior space of the heat shield. The water sprinkler frame further includes a plurality of sprayer nozzles extending radially from the pipe and out an associated opening in one of the faces of the heat shield. In operation, the nozzles function for spraying water therefrom upon the receipt thereof. With reference now to FIG. 1, the linear portions of the water sprinkler frame include four vertically oriented stanchions. The linear portions further form a rectangular structure with four corners coupled to top ends of the stanchions. Mounted on the rectangular structure is a pyramid structure for encompassing a roof of the house. It should be noted that each of the linear portions are all in fluid communication. Next provided is a cylindrical water supply tank situated adjacent to the house. The water supply tank is connected to a lower end of one of the stanchions with a pump coupled therebetween. The pump is adapted for supplying water to the water sprinkler frame upon the receipt of a heat signal. Finally, a plurality of temperature sensors may be either mounted on the ground as shown in FIG. 1 or on the top of the house. The temperature sensors are connected to the pump for transmitting the heat signal thereto upon the detection of a degree of heat greater than a predetermined amount.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new water sprinkler fire prevention system apparatus and method which has many of the advantages of the fire extinguishing systems mentioned heretofore and many novel features that result in a new water sprinkler fire prevention system which is not anticipated, rendered obvious, suggested, or even implied by any of the prior art fire extinguishing systems, either alone or in any combination thereof.

It is another object of the present invention to provide a new water sprinkler fire prevention system which may be easily and efficiently manufactured and marketed.

It is a further object of the present invention to provide a new water sprinkler fire prevention system which is of a durable and reliable construction.

An even further object of the present invention is to provide a new water sprinkler fire prevention system which is susceptible of a low cost of manufacture with regard to both materials and labor, and which accordingly is then susceptible of low prices of sale to the consuming public, thereby making such water sprinkler fire prevention system economically available to the buying public.

Still yet another object of the present invention is to provide a new water sprinkler fire prevention system which provides in the apparatuses and methods of the prior art some of the advantages thereof, while simultaneously overcoming some of the disadvantages normally associated therewith.

Still another object of the present invention is to provide a new water sprinkler fire prevention system for preventing a building from catching fire as a result of a nearby brush fire.

Even still another object of the present invention is to provide a new water sprinkler fire prevention system that includes a water sprinkler frame mounted on a house and having a plurality of sprayer nozzles for spraying water therefrom upon the receipt thereof. Also included is a water supply tank situated adjacent to the house and connected to the sprinkler frame with a pump coupled therebetween for supplying water to the water sprinkler frame upon the receipt of a heat signal. A plurality of temperature sensors may be either mounted on the ground as shown in FIG. 1 or on the top of the house. Such temperature sensors are connected to the pump for transmitting the heat signal thereto upon the detection of a degree of heat greater than a predetermined amount.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
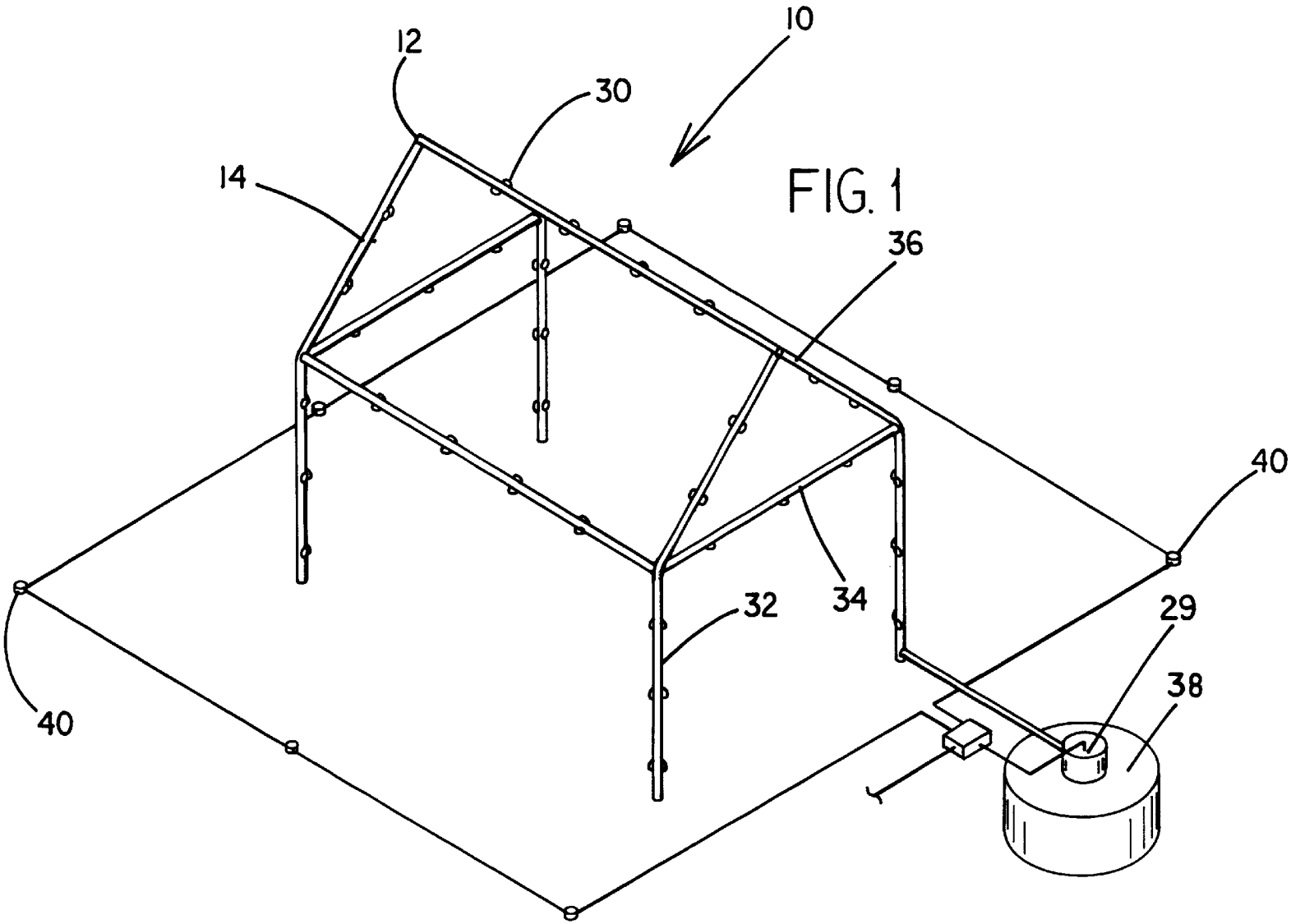
FIG. 1 is a perspective view of a new water sprinkler fire prevention system according to the present invention.
Figure 2:
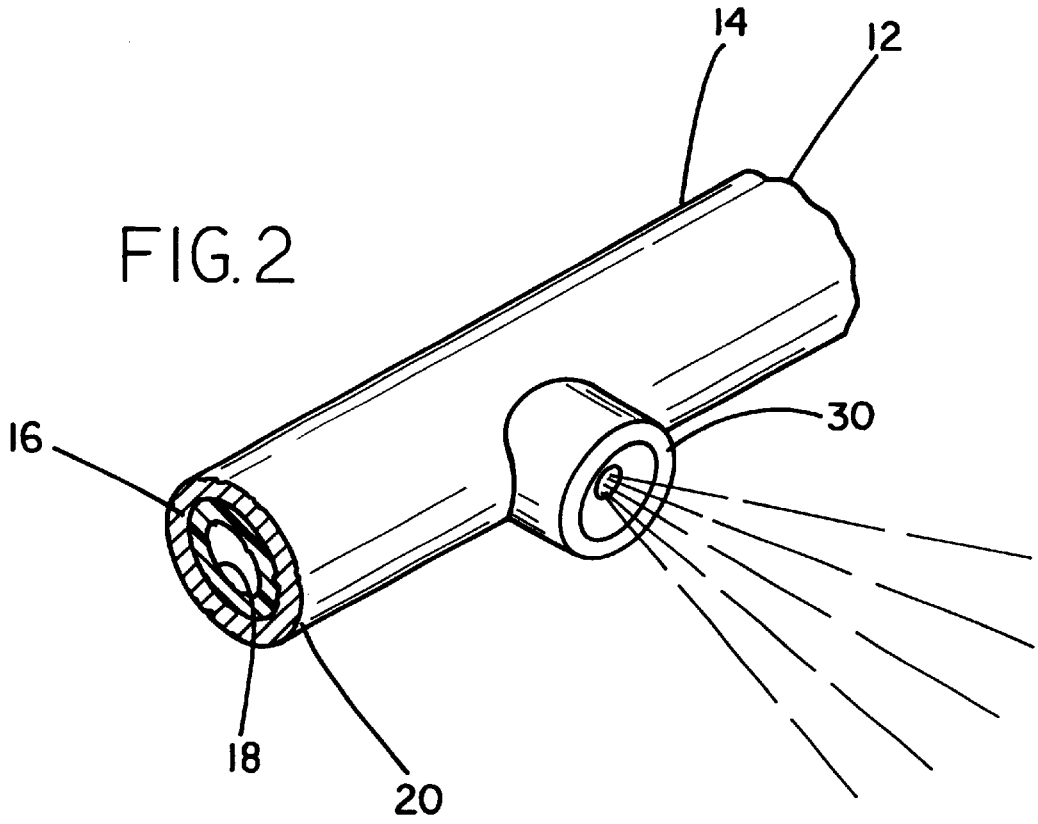
FIG. 2 is a detailed cross-sectional view of the water sprinkler frame of the present invention.
Figure 3:
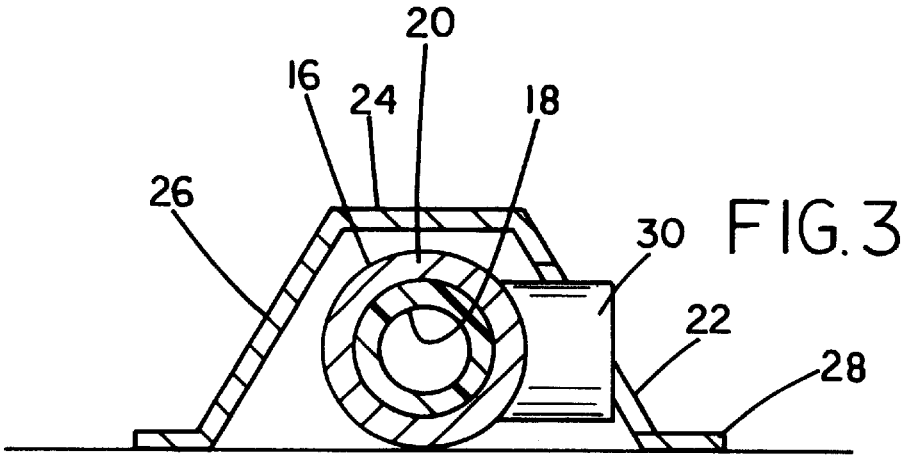
FIG. 3 is a side cross-sectional view of the water sprinkler frame of the present invention with the heat shield thereof.

With reference now to the drawings, and in particular to FIGS. 1 through 3 thereof, a new water sprinkler fire prevention system embodying the principles and concepts of the present invention and generally designated by the reference numeral 10 will be described.

The present invention, designated as numeral 10, includes a water sprinkler frame 12 having a plurality of linear portions 14. Each linear portion has a pipe 16 with an inner plastic layer 18 and an outer metallic layer 20 each with an equal thickness. As shown in FIG. 3, a metallic heat shield 22 is provided including a planar top face 24, a pair of tapering planar side faces 26, and a pair of mounting tabs 28 extending from the side faces in parallel relationship with the top face. By this structure, the heat shield has a trapezoidal cross-section along an entire length thereof. In the alternative, other angled cross-sections may be employed. In use, the mounting tabs of the heat shield are secured to a house with the pipe residing within an interior space of the heat shield. The water sprinkler frame further includes a plurality of sprayer nozzles 30 with conical-shaped recesses extending radially from the pipe and out an associated opening in one of the faces of the heat shield. In operation, the nozzles function for spraying water therefrom upon the receipt thereof. Such spray is ideally perpendicular with respect to the associated pipe. Preferably, a size of a spray area of each nozzle is adjustable.

With reference now to FIG. 1, the linear portions of the water sprinkler frame include four vertically oriented stanchions 32. The linear portions further form a rectangular structure 34 with four corners coupled to top ends of the stanchions. Mounted on the rectangular structure is a pyramid structure 36 for encompassing a roof of the house. The pyramid structure essentially includes a pair of triangular portions with a top portion connected between apexes of the triangular portions. It should be noted that each of the linear portions are all in fluid communication.

The nozzles of the linear portions of the sprinkler frame are preferably configured to spray water on every surface of the house. To accomplish this, the stanchions include two parallel, linearly aligned sets of nozzles directed in two separate directions with 90 degrees of separation. As such, each stanchion of the water sprinkler frame is capable of spraying two faces of the house. Further, the nozzles of the rectangular structure include two parallel, linearly aligned sets of nozzles one of which spray under eaves of the house and another of which sprays upwardly onto the roof of the house. The top portion of the pyramid structure of the water sprinkler frame includes two parallel, linearly aligned sets of nozzles each are angled 45 degrees with respect to each other. Finally, the nozzles of the side portions of the pyramid structure of the water sprinkler frame are angled downwardly.

Next provided is a cylindrical water supply tank 38 situated adjacent to the house. The water supply tank is connected to a lower end of one of the stanchions with a pump 29 coupled therebetween. The pump is adapted for supplying water to the water sprinkler frame upon the receipt of a heat signal. As an option, other water sources may be employed such as a lake, pool or pond.

Finally, a plurality of temperature sensors may be mounted on the ground as shown in FIG. 1, or on the top of the house. Ideally, the temperature sensors are positioned on the top of the house and equally spaced with respect to each other. The temperature sensors are connected to the pump for transmitting the heat signal thereto upon the detection of a degree of heat greater than a predetermined amount of about 100 to 110 degrees. As an option, a manual switch may be included to manually transmit the heat signal to the pump.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A fire prevention system comprising, in combination:

a water sprinkler frame including a plurality of linear portions each having a pipe with an inner plastic layer and an outer metallic layer, a heat shield including a planar top face, a pair of tapering planar side faces, and a pair of mounting tabs extending from the side faces in parallel relationship with the top face, wherein the mounting tabs of the heat shield are secured to a house with the pipe residing within an interior space of the heat shield, the water sprinkler frame further including a plurality of sprayer nozzles extending radially from the pipe and out an associated opening in one of the faces of the heat shield for spraying water therefrom upon the receipt thereof;

said linear portions of the water sprinkler frame including four vertically oriented stanchions, a rectangular structure with four corners coupled to top ends of the stanchions, and a pyramid structure mounted on the rectangular structure for encompassing a roof of the house, wherein each of the linear portions are all in fluid communication;

a cylindrical water supply tank situated adjacent to the house and connected to a lower end of one of the stanchions with a pump coupled therebetween for supplying water to the water sprinkler frame upon the receipt of a heat signal; and a plurality of temperature sensors mounted on the ground and spaced from a perimeter of the house, the temperature sensors connected to the pump for transmitting the heat signal thereto upon the detection of a degree of heat greater than a predetermined amount.

2. A fire prevention system comprising:

a water sprinkler frame mounted on a house and including a plurality of sprayer nozzles for spraying water therefrom upon the receipt thereof;

a water supply tank situated adjacent to the house and connected to the sprinkler frame with a pump coupled therebetween for supplying water to the water sprinkler frame upon the receipt of a heat signal;

a plurality of temperature sensors the temperature sensors connected to the pump for transmitting the heat signal thereto upon the detection of a degree of heat greater than a predetermined amount; and wherein the water sprinkler frame includes at least one pipe with an inner plastic layer and an outer metallic layer.

3. The fire prevention system as set forth in claim 2, wherein each one of said plurality of temperature sensors being mounted on the ground and spaced from a perimeter of the house.

4. The fire prevention system as set forth in claim 2, wherein each one of said plurality of temperature sensors being mounted on the top of the house.

5. The fire prevention system as set forth in claim 2 wherein the water sprinkler frame includes a plurality of linear portions including vertically oriented stanchions, a rectilinear structure with multiple corners coupled to top ends of the stanchions, and a 3-D rectilinear structure mounted on the structure for encompassing a roof of the house, wherein each of the linear portions are all in fluid communication.

6. The fire prevention system as set forth in claim 2 wherein the water sprinkler frame includes a heat shield in which pipes of the water sprinkler frame are situated.

7. The fire prevention system as set forth in claim 4 wherein the heat shield includes at least one tapering face for deflecting heat.

* * * * *